US012729542B2

(12) United States Patent
Hull et al.

(10) Patent No.: US 12,729,542 B2
(45) Date of Patent: Sep. 8, 2026

(54) BUILDING SURFACE PRODUCT INCLUDING EMBEDDED FASTENER, BUILDING SURFACE SYSTEM, AND METHOD OF MANUFACTURE

(71) Applicant: CertainTeed Gypsum, Inc., Malvern, PA (US)

(72) Inventors: Michael Hull, Cambridge, MA (US); Evan Molony, Northborough, MA (US); William Lentlie, Worcester, MA (US)

(73) Assignee: CertainTeed Gypsum, Inc., Malvern, PA (US)

( * ) Notice: Subject to any disclaimer, the term of this patent is extended or adjusted under 35 U.S.C. 154(b) by 206 days.

(21) Appl. No.: 18/226,346

(22) Filed: Jul. 26, 2023

(65) Prior Publication Data

US 2024/0035286 A1 Feb. 1, 2024

Related U.S. Application Data

(60) Provisional application No. 63/392,287, filed on Jul. 26, 2022.

(51) Int. Cl.
*E04F 13/08* (2006.01)

(52) U.S. Cl.
CPC ..... *E04F 13/0833* (2013.01); *E04F 13/0837* (2013.01)

(58) Field of Classification Search
CPC .... E04D 2001/3426; E04D 2001/3467; E04D 1/34; E04F 13/07; E04F 13/076;
(Continued)

(56) References Cited

U.S. PATENT DOCUMENTS 2,991,592 A * 7/1961 Rauen ..... E04F 13/0864 52/531
4,028,857 A * 6/1977 Fischer ..... E04F 13/0853 52/704

(Continued)

FOREIGN PATENT DOCUMENTS

CN 133 187 188 A 7/2021
EP 2 436 851 A2 4/2012

(Continued)

OTHER PUBLICATIONS

International Preliminary Report on Patentability of International Patent Application No. 2023/028651, dated Jan. 28, 2025.

*Primary Examiner* — Kyle J. Walraed-Sullivan
(74) *Attorney, Agent, or Firm* — McDonnell Boehnen Hulbert & Berghoff LLP

(57) ABSTRACT

A building surface product includes a panel having front and rear surfaces, first and second sides, first and second ends, and a gypsum body between the front surface and rear surface. A first hole extends through the gypsum body and includes a front end and a rear end. A first fastener assembly is positioned in the first hole. The first fastener assembly includes an embedded fastener and a linking fastener. The embedded fastener has a threaded body that extends through the first hole of the gypsum body and has a front end a rear end, and a lateral projection disposed at the front end of the threaded body. The linking fastener includes a threaded body that engages the threaded body of the embedded fastener. The linking fastener extends outward from the rear end of the first hole. The first fastener assembly is contained behind the front surface of the panel.

24 Claims, 7 Drawing Sheets

(58) Field of Classification Search
CPC ... E04F 13/08; E04F 13/0801; E04F 13/0805; E04F 13/081; E04F 13/0816; E04F 13/0817; E04F 13/0832; E04F 13/0833; E04F 13/0835; E04F 13/0837; E04F 13/0846; E04F 13/085; E04F 13/0864; E04F 13/0889; E04F 13/0892; E04F 13/21; E04F 13/24
See application file for complete search history.

(56) References Cited

U.S. PATENT DOCUMENTS 4,360,993 A * 11/1982 Tomokazu ..... F16B 5/0233 52/378
4,653,244 A * 3/1987 Farrell ..... F16B 35/048 411/413
5,257,490 A * 11/1993 Endo ..... E04F 13/0835 52/746.1
5,542,225 A * 8/1996 Endo ..... F16B 21/078 52/704
2002/0095901 A1* 7/2002 Tremblay ..... E04D 1/18 52/553
2003/0046891 A1* 3/2003 Colada ..... B32B 13/12 52/541
2004/0231252 A1* 11/2004 Benjamin ..... E04F 21/00 52/578
2006/0162273 A1* 7/2006 Viezens ..... E04F 13/0837 52/698
2011/0064539 A1* 3/2011 Ghatikar ..... E04F 13/0837 411/371.2
2011/0250035 A1* 10/2011 Goldberg ..... E04B 2/707 411/366.1
2012/0304572 A1* 12/2012 Aboukhalil ..... E04F 13/10 52/489.1
2018/0112412 A1* 4/2018 Mao-Cheia ..... E04F 11/1812
2019/0330856 A1* 10/2019 MacPherson ..... E04F 13/0894
2019/0345723 A1* 11/2019 Immordino, Jr. ... E04F 13/0883
2021/0222440 A1* 7/2021 Hochstetler ..... E04F 11/116
2022/0064961 A1* 3/2022 Briggs ..... E04F 13/14
2023/0009126 A1* 1/2023 Plaschkes ..... F16B 25/0068
2023/0183985 A1* 6/2023 Bruckerhoff ..... E04F 13/083 52/506.05
2023/0250641 A1* 8/2023 Ferguson ..... E04F 13/30 52/489.1
2023/0265651 A1* 8/2023 Molony ..... E04B 2/7453 52/506.09

FOREIGN PATENT DOCUMENTS

EP 3 133 224 A1 2/2017
WO 98/17881 A1 4/1998

* cited by examiner

BUILDING SURFACE PRODUCT INCLUDING EMBEDDED FASTENER, BUILDING SURFACE SYSTEM, AND METHOD OF MANUFACTURE

BACKGROUND OF THE DISCLOSURE

This application claims the benefit of priority of U.S. Provisional Patent Application No. 63/392,287, filed Jul. 26, 2022, which is hereby incorporated herein by reference in its entirety.

BACKGROUND OF THE DISCLOSURE

1. Field of the Disclosure

The present disclosure relates generally to building surface systems, for example, suitable for forming an internal or external surface of a building. The present disclosure relates more particularly to a building surface product including an embedded fastener.

2. Technical Background

Prefabricated panels, for example gypsum panels that are commonly referred to as drywall, are often used to construct building surfaces. The panels are attached to a supporting structure, such as the joists of a wall frame. Once the panels are hung on the supporting structure, the surface is finished using joint compound or another material to create a smooth surface. The surface may then be painted or covered with wall paper.

Gypsum panels are advantageous for use as a building surface for various reasons. Such panels are incredibly durable, have excellent fire resistance, are easily repaired, and are easy to mount on a supporting structure. Typically, mounting gypsum panels only requires attaching the panels to an underlying supporting structure using mechanical fasteners, such as screws.

While the mounting of gypsum panels is straightforward, most panels are finished by covering the joints between the panels and the fasteners in order to create a smooth surface. The panels are then painted or covered with wall paper to create a pleasing aesthetic. The process of finishing the building surface is time consuming, as each application of joint compound or paint should be dried before the subsequent step can be performed. Moreover, the finishing steps require uncommon skills.

For these reasons, the present inventors have determined that a building surface product that can be installed more quickly would be attractive to both builders and customers.

SUMMARY OF THE DISCLOSURE

In one aspect, the present disclosure provides a building surface product comprising:

- a substantially planar panel having a front surface, a rear surface, a first side, a second side, a first end, a second end, a gypsum body between the front surface and rear surface, and a first hole extending through the gypsum body and having a front end and a rear end; and
- a first fastener assembly positioned in the first hole and contained behind the front surface of the panel, the first fastener assembly comprising:
  - an embedded fastener including a threaded body that extends through the first hole and has a front end a rear end, and a lateral projection disposed at the front end of the threaded body, and
  - a linking fastener including a threaded body that engages the threaded body of the embedded fastener, the linking fastener extending outward from the rear end of the first hole.

In another aspect, the disclosure provides a building surface system comprising:

- a support structure including a plurality of framing members that form a support surface; and
- a first building surface product according to the disclosure attached to the support structure.

In another aspect, the disclosure provides a method of forming the building surface system according to the disclosure, the method comprising:

- positioning the first building surface product against the support structure;
- securing the first building surface product to the support structure;
- position the second building surface product against the support structure and adjacent to the first building surface product; and
- securing the second building surface product to the support structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional building surface products are time-consuming to install and require skill to finish. The present inventors have determined that a building surface product that can be installed more quickly and without requiring specific skills to finish would be attractive to builders and customers.

Accordingly, one aspect of the disclosure is a building surface product including a substantially planar panel having a front surface, a rear surface, a first side, a second side, a first end, a second end, and a gypsum body between the front surface and rear surface. A first hole extends through the gypsum body and includes a front end and a rear end. A first fastener assembly is positioned in the first hole and contained behind the front surface of the panel. The first fastener assembly includes an embedded fastener and a linking fastener. The embedded fastener includes a threaded body that extends through the first hole of the gypsum body and has a front end a rear end, and a lateral projection disposed at the front end of the threaded body. The linking fastener includes a threaded body that engages the threaded body of the embedded fastener. Further, the linking fastener extends outward from the rear end of the first hole.

Figure 1A:
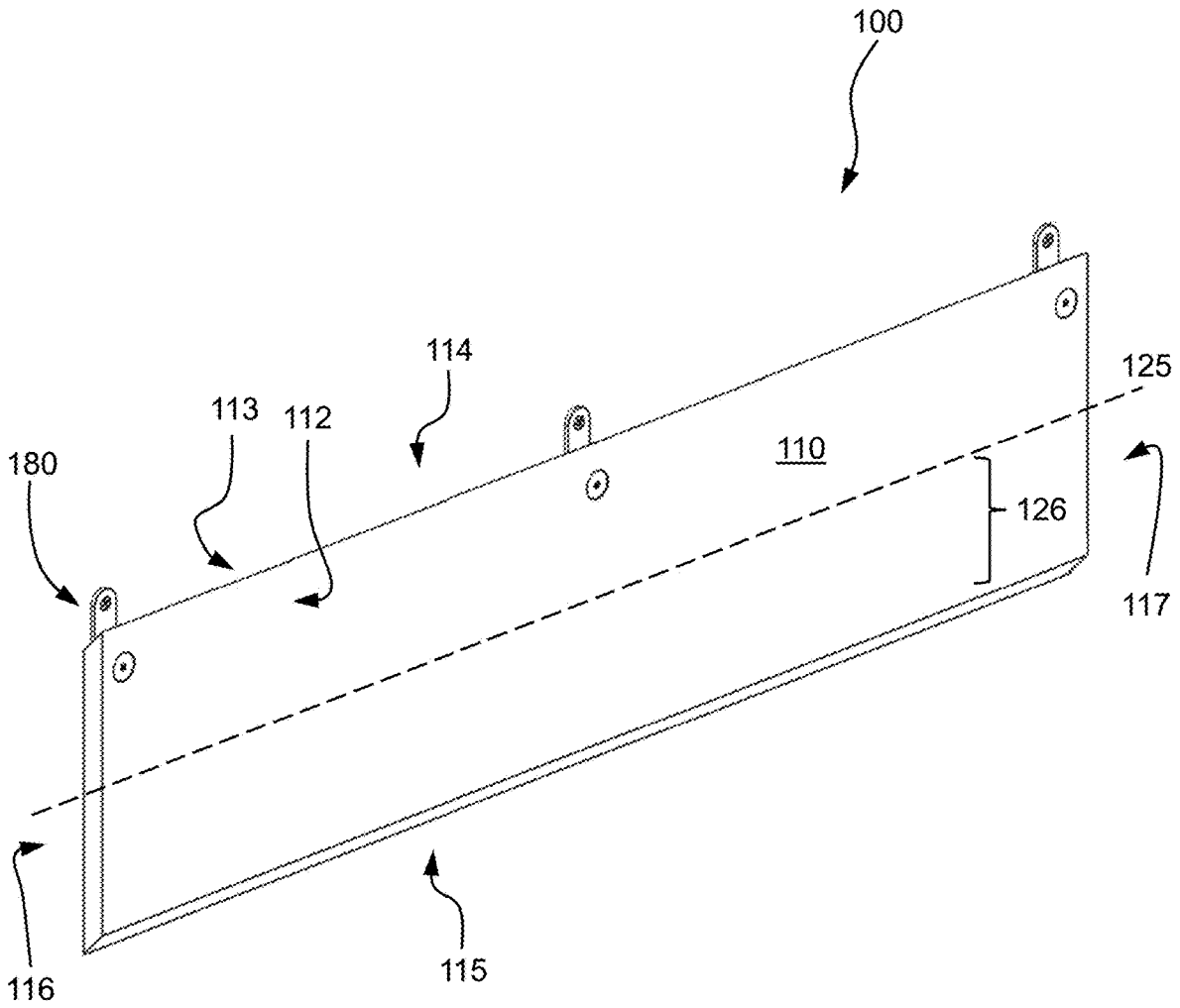
FIG. 1A is a schematic perspective view of a building surface product according to an embodiment of the disclosure.
Figure 1B:
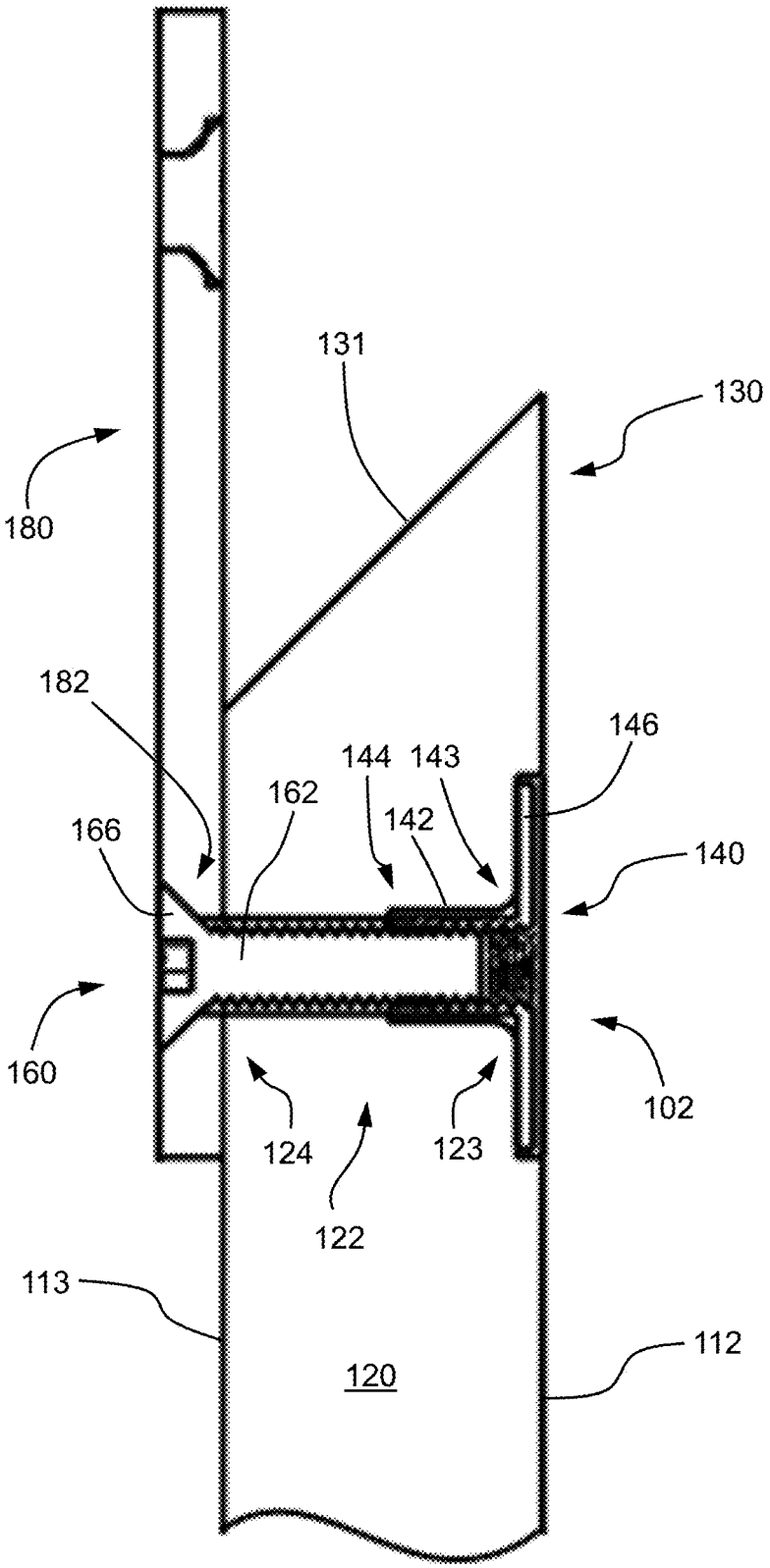
FIG. 1B is a schematic cross-sectional view of a portion of the building surface product of FIG. 1A.

Such a building surface product is shown in FIG. 1A. Building surface product 100 includes a substantially planar panel 110 having a front surface 112, a rear surface 113, a first side 114, a second side 115, a first end 116, and a second end 117. As shown in FIG. 1B, panel 110 includes a gypsum body between the front surface 112 and rear surface 113. A first hole 122 extends through the gypsum body 120 and includes a front end 123 and a rear end 124. A first fastener assembly 102 is positioned in the first hole 122. The first fastener assembly 102 includes an embedded fastener 140 and a linking fastener 160. The embedded fastener 140 includes a threaded body 142 that extends through the first hole 122 of the gypsum body 120. Further, the threaded body 142 has a front end 143 a rear end 144. A lateral projection 146 is disposed at the front end 143 of the threaded body 142. The lateral projection 146 helps to hinder removal of the embedded fastener 140 through the first hole 122. For example, the lateral projection 146 may be configured to project beyond the diameter of the first hole 122 so that attempted removal of the embedded fastener 140 through the rear end 124 of the first hole 122 will result in the lateral projection 146 interfering with the edge of the gypsum body 120 that surrounds the first hole 122.

The linking fastener 160 includes a threaded body 162 that engages the threaded body 142 of the embedded fastener 140. At the rear end 124 of the first hole 122, the linking fastener 160 extends outward from the first hole 122 so that it may engage another component. Accordingly, the linking fastener 160 can secure the panel 110 to another structure in order to mount the building surface product 100. On the other hand, the entire fastener assembly 102 is contained behind the front surface 112 of the panel 110.

The phrase "contained behind," as used herein means that the no portion of the fastener assembly extends past the front surface of the panel. In other words, the entirety of the structure of each component of the fastener assembly is behind, or rearward of, the plane formed by the front surface of the panel, and the surfaces of the components of the fastener assembly are either flush with or behind the front surface of the panel. The phrase "contained behind" does not necessitate that any part of the fastener assembly be covered or obscured by the front surface, but rather only that the fastener assembly be positioned rearward of the front surface. By having the fastener assembly contained behind the front surface of the panel, the fastener assembly can be entirely obscured when the panel is finished with coating materials or paint, as explained further below.

In some embodiments, the first hole through the panel is pre-formed prior to insertion of either the embedded fastener or the linking fastener. In other embodiments at least a portion of the first hole is formed by the insertion of parts of the fastener assembly into the gypsum body of the panel.

In various embodiments of the building surface product as otherwise described herein, the first hole is one of a plurality of holes in the panel and the first fastener assembly is one of a plurality of fastener assemblies of the building surface product. For example, as shown in FIG. 1A, building surface product 100 includes three holes and corresponding fastener assemblies along the first side 114 of the panel.

In various embodiments of the building surface product as otherwise described herein, the threaded body of the embedded fastener includes a hollow barrel with internal threads, and the threaded body of the linking fastener includes a shaft with external threads. For example, the threaded body 142 of embedded fastener 140 includes a hollow circular barrel with internal threads. The linking fastener 160 includes a shaft 162 with external threads that forms the threaded body. The external threads of the shaft 162 are configured to mate with the internal threads of hollow barrel 142 so that the linking fastener 160 may be coupled to the embedded fastener 140.

In various embodiments of the building surface product as otherwise described herein, the lateral projection of the embedded fastener includes a flat base extending radially outward from the threaded body of the embedded fastener. For example, embedded fastener 140 includes a flat base 146 positioned at the front end 143 of internally threaded hollow barrel 142. The flat base 146 extends radially outward around the circumference of hollow barrel 142. Further, the flat base 146 is larger than the diameter of first hole 122, which inhibits embedded fastener 140 from being removed from the front end 123 of first hole 122. While, the flat base 146 of embedded fastener 140 is circular, in other embodiments, the flat base may have another shape, such as square or hexagonal. Further still, in other embodiments, the embedded fastener may have a lateral projection that has a different configuration, such as a hook or arm that extends radially from the threaded body in only one direction, rather than circumferentially.

In various embodiments of the building surface product as otherwise described herein, the embedded fastener is formed as a tee nut. For example, the embedded fastener 140 of building surface product 100 is formed as a standard tee nut including the base 146 and hollow threaded barrel 142.

In various embodiments of the building surface product as otherwise described herein, the linking fastener includes a head that extends radially outward from the threaded body, and the head of the linking fastener is positioned outside of the first hole. For example, linking fastener 160 includes a head 166 at the rear end of shaft 162, which can be used to secure the linking fastener 160 to another component or structure, such as a tab as described below. Alternatively, in some embodiments, the shaft of the linking fastener may be formed without a head. For example, in some embodiments, a nut may be threaded onto the shaft in order to secure the linking fastener to another component or structure.

In various embodiments of the building surface product as otherwise described herein, the linking fastener is formed as a bolt. For example, linking fastener 160 of the embodiment shown in FIGS. 1A and 1B is formed as a bolt with a countersunk head having a flat top. In other embodiments, the linking fastener has other configurations, including other bolt configurations.

In various embodiments of the building surface product as otherwise described herein, the embedded fastener is contained between the front surface and the rear surface of the panel. For example, as shown in FIG. 1B, the length of embedded fastener 140 is about half of the thickness of panel 110, and embedded fastener 140 is positioned just behind the front surface 112. Accordingly, the rear end of embedded fastener 140, which is formed by the rear end 144 of threaded body 142, is about halfway between the front surface 112 and rear surface 113 of panel 110, such that the entire embedded fastener 140 is contained between the front surface 112 and rear surface 113.

Figure 1C:
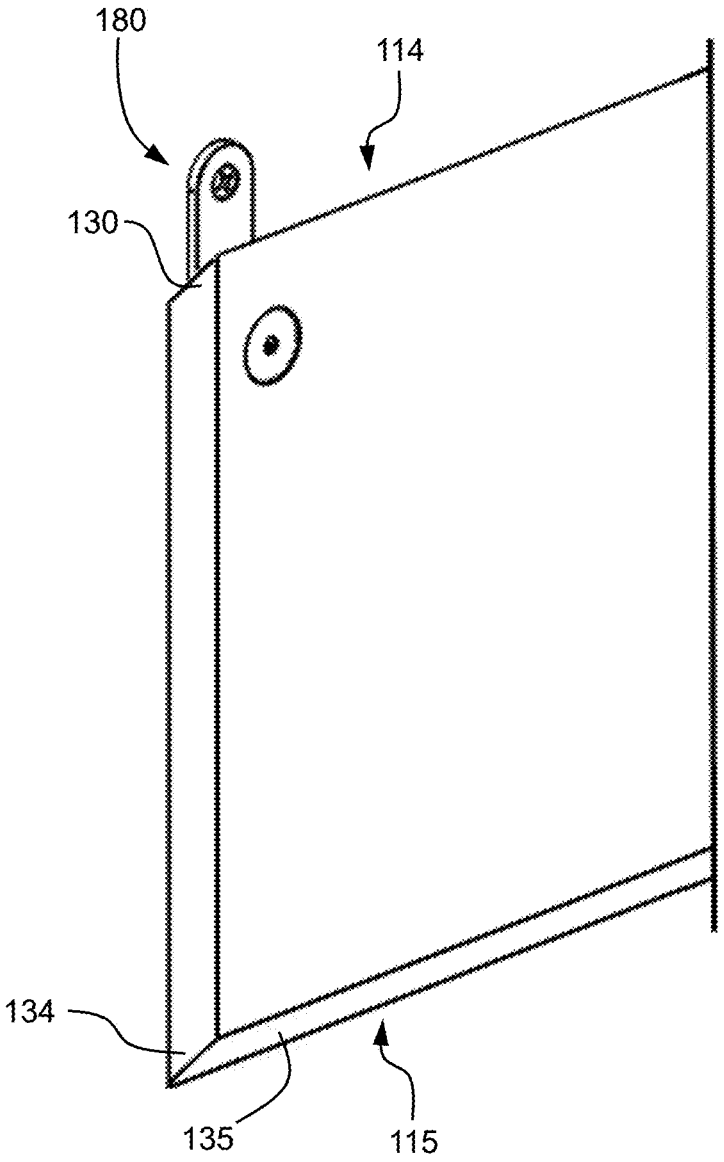
FIG. 1C is a schematic perspective view of a portion of the building surface product of FIG. 1A.

In various embodiments of the building surface product as otherwise described herein, the panel includes a first projection extending along the first side of the panel and positioned at the front surface of the panel, and a second projection extending along the second side of the panel and configured to fit behind a first projection of a neighboring panel. For example, panel 110 includes a first projection 130 that extends along the first side 114 of the panel 110 and a second projection 134, as shown in FIG. 1C, that extends along the second side 115 of the panel 110. The first projection 130 is located toward the front surface 112 while the second projection 134 is located toward the rear surface 113. Accordingly, when two similarly configured panels are placed adjacent to one another, the first projection of one panel can cooperate with the second projection of the other panel, such that the first projection sits in front of the corresponding second projection, as explained further below.

In building surface product 100, as shown in FIGS. 1A-1C, the first side 114 of panel 110 is positioned at the top of the panel, such that the projection at the front of the panel 110 is on the top of the panel. In other embodiments, the first side of the panel may be positioned at the bottom of the panel. In various embodiments, each of the first and second projections extend in a direction that is parallel to the front and rear surfaces of the panel. For example, in panel 110, the first projection 130 extends upward and the second projection 134 extends downward.

In various embodiments of the building surface product as otherwise described herein, the first projection has an angled rear face and the second projection has an angled front face. For example, in building surface product 100, first projection 130 is formed by an upward extension of the front surface 112 of the panel 110 and an angled rear face 131 (FIG. 1B) that extends down from the front surface 112 toward the rear surface 113. Likewise, the second projection 134 is formed by a downward extension of the rear surface 113 of the panel 110 and an angled front face 135 (FIG. 1C) that extends upward from the rear surface 113 of the panel 110 toward the front surface 112. The angled rear face 131 of the of the first projection 130 and the angled front face 135 of the second projection 134 are disposed at the same angle to the front and rear surfaces 112, 113 of the panel 110 so that the respective first and second projections of neighboring panels can engage one another.

In various embodiments of the building surface product as otherwise described herein, a portion of the panel extending from a centerline of the panel to the second side of the panel is free of fasteners. For example, in building surface product 100, the lower portion 126 of the panel 110 that lies below the centerline 125 is free of any fasteners. As explained in more detail below, when installed, the lower portion 126 of the panel 110 may be secured to a support surface by pressing the second projection 134 of the panel 110 rearward through engagement with the panel of a neighboring building surface product. On the other hand, in some embodiments, the panel may include fasteners on both sides of the centerline. For example, in some embodiments, the panel may be held against a support surface using fasteners positioned at least at each corner of the panel.

In various embodiments of the building surface product as otherwise described herein, the building surface product includes a first tab that is secured to the panel by the linking fastener. For example, building surface product 100 includes a first tab 180 that is held against the rear surface 113 of panel 110 by linking fastener 160. In particular, first tab 180 includes a hole 182 with a countersink that receives linking fastener 160. Accordingly, when linking fastener 160 is tightened into embedded fastener 140, the tab 180 is wedged between rear surface 113 of panel 110 and the head 166 of linking fastener. Such a tab may be formed of metal, such as aluminum or steel, plastic, wood, bamboo, or another material.

The tab 180 is configured to allow the building surface product 100 to be easily installed against a support structure, as explained further below. For example, the tab 180 can secured to a support structure with a fastener, such as a screw or a bolt. The use of the tab 180 may allow the building surface product 100 to be installed from the front of a support structure without having to penetrate the gypsum body 120 of the panel 110 at an installation site. This can substantially reduce installation times, because finishing of the panel at the installation site can be avoided.

In various embodiments of the building surface product as otherwise described herein, the first tab extends outward from the first side of the panel. For example, in building surface product 100, tab 180 extends upward from first side 114. Accordingly, when the tabs 180 are secured to a support structure, the panels hang from the tabs 180 via the fastener assembly 102. In other embodiments, the tabs extend laterally outward from the ends of the panels. Further, in some embodiments, the tabs bend rearward and do not extend outward past the perimeter of the panel.

In various embodiments of the building surface product as otherwise described herein, the embedded fastener is covered at the first surface of the panel by a material layer. For example, in some embodiments, the front of the embedded fastener is covered by a joint compound, stucco, a putty, or another material that may be spread over the embedded fastener. Such a material layer may be provided over the embedded fastener during manufacture of the building surface product. Accordingly, the installers of the building surface product can avoid spending time obscuring the fastener assemblies that extend through the panel. Likewise, in some embodiments, a layer of paint extends across the front surface of the panel and over the embedded fastener so as to obscure the embedded fastener. Similar to the material layer, the layer of paint may be provided over the front surface during manufacture of the building surface product. In other embodiments, however, the layer of paint may be formed at the installation site. Further, in some embodiments, the front finishing may be accomplished by the addition of an additional layer of a material, such as a lamination or a paper, film, fabric or plastic. In this and the other embodiments, the finishing serves to obscure the fastener assemblies.

Figure 1D:
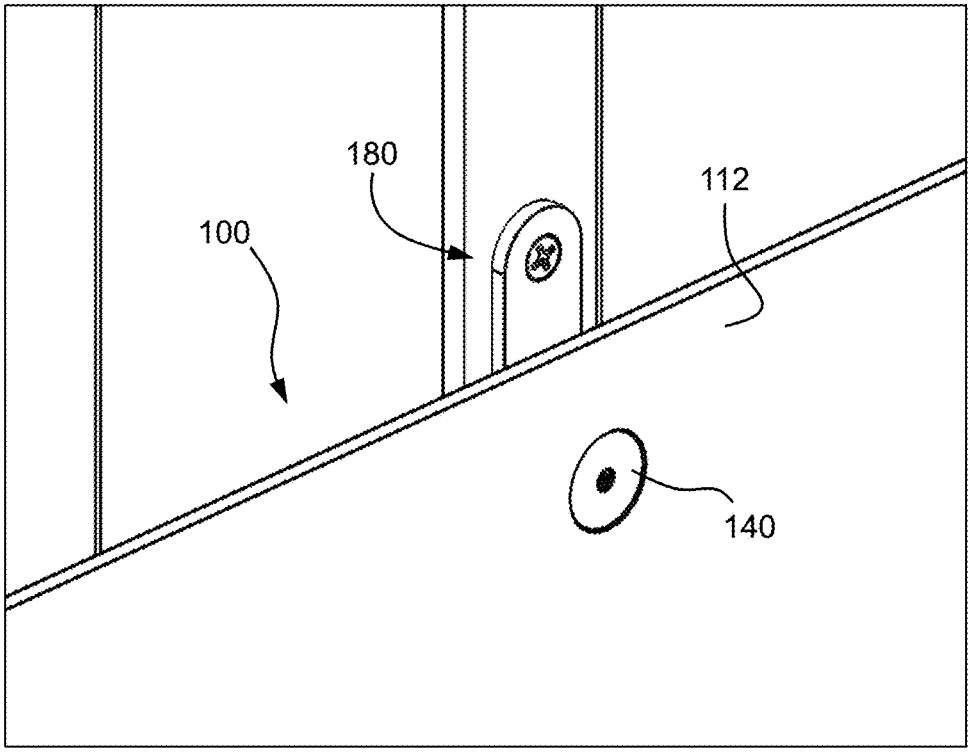
FIG. 1D is a schematic perspective view of a portion of the building surface product of FIG. 1A with an embedded fastener exposed.
Figure 1E:
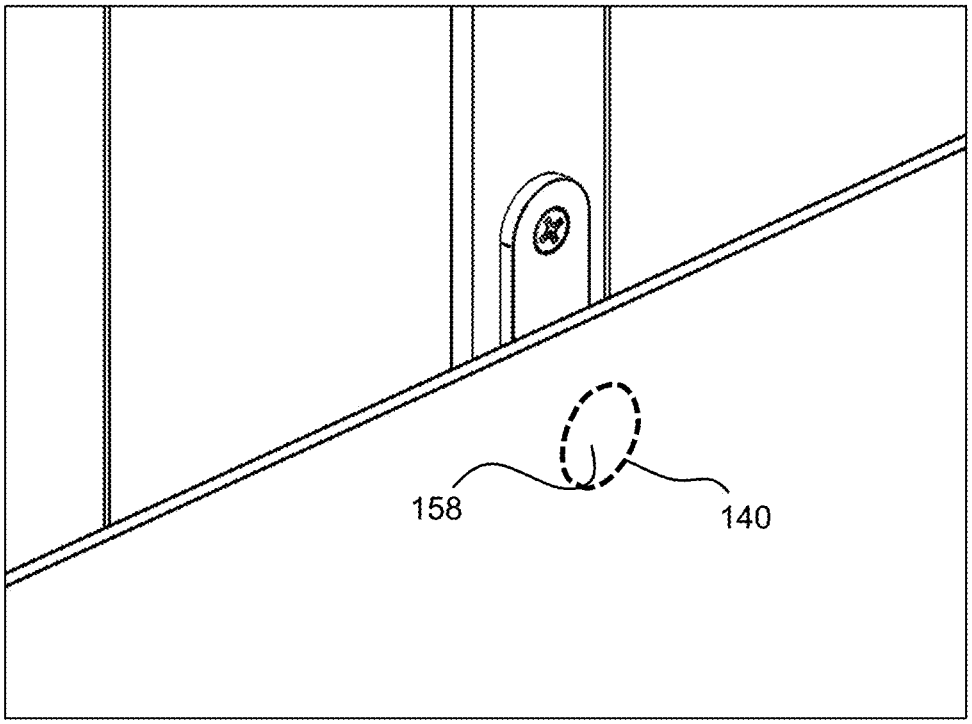
FIG. 1E is a schematic perspective view of the portion of FIG. 1D with the embedded fastener covered.

FIGS. 1D and 1E illustrate the covering of a front end of the embedded fastener 140 of building surface product 100. For example, in FIG. 1D, embedded fastener 140 is slightly rearward of front surface 112 (and thus, is contained behind front surface 112), but is exposed. In contrast, in FIG. 1E, the front end of embedded fastener 140 has been covered over by a material layer 158 and a layer of paint. While the outline of embedded fastener 140 is shown in FIG. 1E by a dashed line, the embedded fastener 140 has been obscured by the material layer 158 and paint.

Figure 2:
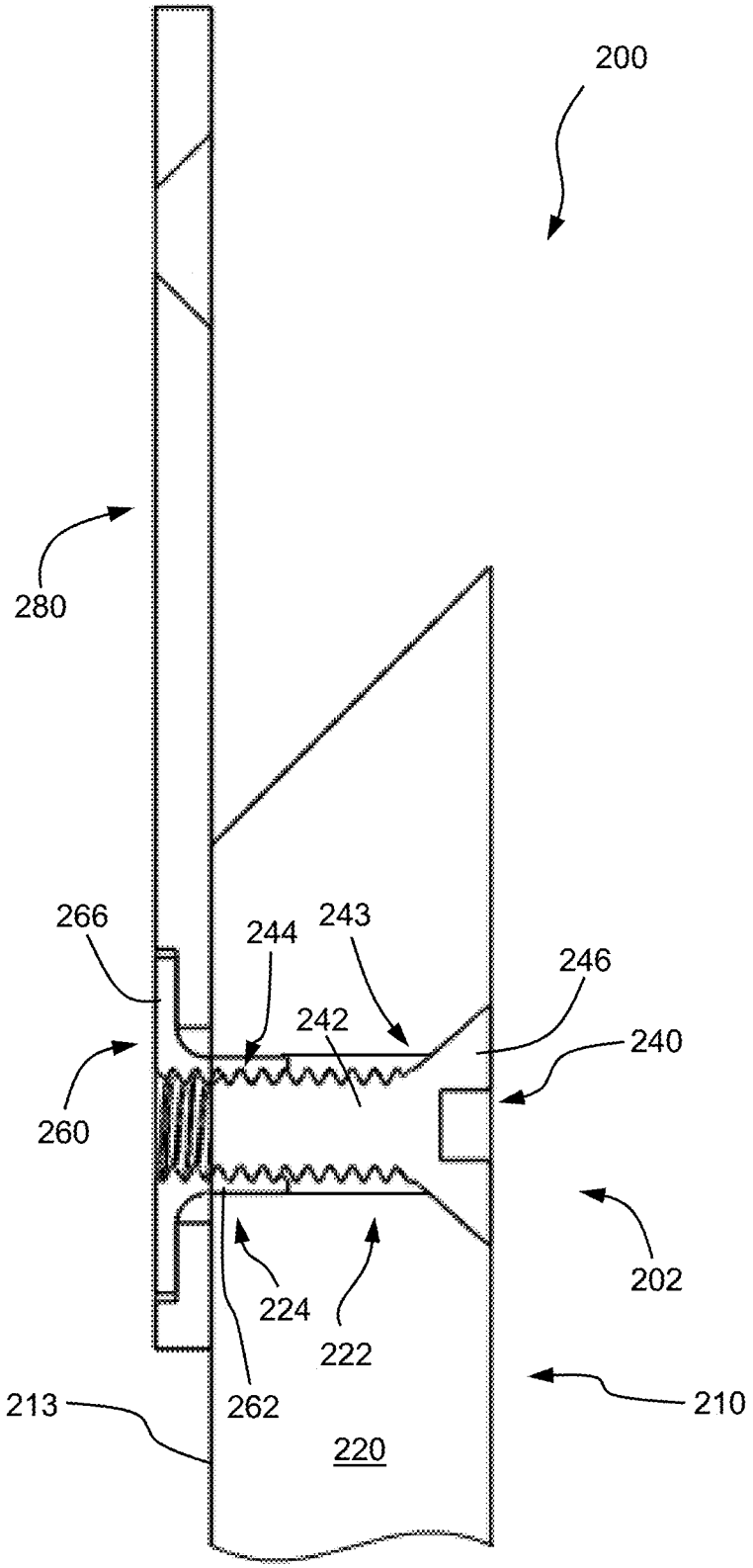
FIG. 2 is a schematic cross-sectional view of a portion of a building surface product according to another embodiment of the disclosure.

In various embodiments of the building surface product as otherwise described herein, the threaded body of the embedded fastener includes a shaft with external threads, and the threaded body of the linking fastener includes a barrel with internal threads. A cross section of a portion of such an embodiment is shown in FIG. 2. As shown, building surface product 200 includes a panel 210 with gypsum body 220 that has a first hole 222. A first fastener assembly 202 is positioned in first hole 222 and includes an embedded fastener 240 and a linking fastener 260. The embedded fastener 240 includes a threaded body 242 in the form of a shaft that extends through the first hole 222 of the gypsum body 220. Further, the threaded body 242 has a front end 243 a rear end 244. A lateral projection 246 is disposed at the front end 243 of the threaded body 242. The linking fastener 260 includes a threaded body 262 in the form of an internally threaded barrel that engages the threaded shaft 242 of the embedded fastener 240. At the rear end 224 of the first hole 222, the linking fastener 260 extends outward from the first hole 222 so that it may engage another component.

In various embodiments of the building surface product as otherwise described herein, the lateral projection of the embedded fastener is formed by a head at the front end of the embedded fastener. For example, embedded fastener 240 is in the form of a bolt and includes a head 246 at the front end of threaded shaft 242. The head 246 may hinder removal of the embedded fastener 240 toward the rear surface 213 of the panel 210.

In various embodiments of the building surface product as otherwise described herein, the linking fastener includes a base extending radially outward from the threaded body, and the base is positioned outside the first hole. For example, linking fastener 260 of building surface product 200 is formed as a tee nut and includes a flat base 266 that secures a tab 280 to the rear surface 213 of panel 210.

The gypsum body of the panel may be formed by a continuous layer of gypsum that extends from the front surface to the rear surface. The phrase continuous layer refers to a structure where adhered gypsum material extends throughout the layer without a gap or separate material extending through the layer. On the other hand, the continuous layer may have varying properties of the gypsum material across the layer, such as density or composition. Further, the layer of gypsum may contain reinforcing materials such as scrims that may be common in such structures. Such reinforcement materials may be integral to the structure and be permeated by the gypsum material.

In various embodiments of the building surface product as otherwise described herein, a width of the panel from the first side to the second side is at least 3 inches, e.g., at least 4 inches, e.g., at least 6 inches. In some embodiments, the width of the panel from the first side to the second side is no more than 9 feet, e.g., no more than 4 feet, e.g., no more than 3 feet. For example, in some embodiments, the width of the panel is in a range from 3 inches to 6 feet, e.g., from 4 inches to 4 feet, e.g., from 6 inches to 3 feet.

In various embodiments of the building surface product as otherwise described herein, a length of the panel from the first end to the second end is at least 1 foot, e.g., at least 2 feet, e.g., at least 4 feet. In some embodiments, the length of the panel from the first end to the second end is no more than 20 feet, e.g., no more than 15 feet, e.g., no more than 12 feet. For example, in some embodiments, the length of the panel is in a range from 1 foot to 20 feet, e.g., from 2 feet to 15 feet, e.g., from 4 feet to 12 feet.

In various embodiments of the building surface product as otherwise described herein, a thickness of the panel is at least ⅜ inch, e.g., at least ½ inch, e.g., at least ¾ inch. In some embodiments, the thickness of the panel is no more than 4 inches, e.g., no more than 3 inches, e.g., no more than 2 inches. For example, in some embodiments, the thickness of the panel is in a range from ⅜ inch to 4 inches, e.g., from ½ inch to 3 inches, e.g., from ¾ inch to 2 inches.

In various embodiments of the building surface product as otherwise described herein, the gypsum body comprises a reinforced gypsum material. The use of a reinforced gypsum material can enhance the connection between the panel and the attachment posts that are attached to the panel. Moreover, the use of a reinforced gypsum material can also provide extra stability for the panel in the vicinity of the attachment posts. For example, in some embodiments, the gypsum body includes at least 1% by weight polymer. Reference to the weight percentage of a component of the gypsum body, as used herein, refers to the weight after the gypsum has set. In various embodiments, the polymer includes starch and/or polyvinyl acetate.

In various embodiments of the building surface product as otherwise described herein, the gypsum body includes at least 1% by weight of reinforcing fibers. For example, in some embodiments, the gypsum body includes glass fibers. Further, in some embodiments, the gypsum panel includes cellulose-based fibers. Moreover, in some embodiments, the gypsum panel includes polyethylene, polypropylene or polyester fibers. Various embodiments of the building surface product include different combinations of the aforementioned fibers in the gypsum panel.

In some embodiments, the gypsum body includes one or more additives, such as biocides, hydrophobic additives, and fire resistance additives.

In various embodiments of the building surface product as otherwise described herein, the panel is rectangular. For example, as shown in FIG. 1A, the shape of building surface product 100 is governed by panel 110 which has a rectangular form. In particular, the first edge 118 along first side 114 runs parallel to the second edge 119 along second side 115 and the two edges 118, 119 run across the width of panel 110. Likewise, the edge at first end 116 is parallel to the edge at second end 117. Moreover, the sides and ends of panel 110 are perpendicular to one another such that the shape of panel 110 is that of a rectangle. In other embodiments, the building surface product has another shape. For example, in some embodiments, the building surface product includes a panel having a different rectangular shape (including a square shape). Further, in some embodiments, the panel is formed as a trapezoid, triangle, square, hexagon, or other polygon.

In some embodiments the building surface product is configured to form a wall surface or ceiling surface. For example, panel 110 of building surface product 100 is a wall panel. In other embodiments, the building surface product is configured to form a trim or decorative element. For example, in some embodiments, the panel of the building surface product is formed as a trim or decorative component that is attached to a support structure using the attachment posts of the disclosure. For example, in some embodiments the panel is a molding component, such as crown molding at the top of the building surface. In other embodiments, the panel forms a baseboard at the bottom of a building surface. Still in other embodiments, the panel forms corner trim or window trim. Various shapes for such trim configurations are possible. For example, in some embodiments, the trim may be flat, angled or curved. Likewise, such trim can be proud, flush or recessed. Still, in other embodiments the building surface product forms a decorative beam. In some embodiments, the building surface product passes over the middle of a building surface. For example, in some embodiments, the panel of the building surface product forms a chair rail, a batten or has another configuration that passes over the middle of the surface. In some embodiments, the building surface product includes a panel configured as a trim or decorative element and is formed of a polymer or wood and the first attachment post extends only partially through the panel.

In various embodiments of the building surface product as otherwise described herein, the building surface product further includes a facing sheet that lines the gypsum body along at least one of the front surface and the rear surface. In some embodiments, the facing sheet is a paper facing. In other embodiments, the facing sheet includes reinforcing fibers. For example, in some embodiments, the facing sheet includes a fiberglass mat. Further, in some embodiments, the gypsum material is embedded into the facing sheet.

In various embodiments of the building surface product as otherwise described herein, the facing sheet surrounds the panel along its length covering both the front surface and the rear surface. For example, in some embodiments, the facing sheet is formed from two distinct sheets that are wrapped around the gypsum panel. The facing sheets may then be attached to one another to surround the panel. In some embodiments, the facing sheets wrap around the panel along its length. The ends of the panel may then either be left uncovered or the facing sheets may also be folded over the ends.

In another aspect, the disclosure provides a building surface system including a support structure, a first building surface product according to the disclosure attached to the support structure, and a second building surface product according to the disclosure attached to the support structure and adjacent to the first building surface product. The support structure includes a plurality of framing members that form a support surface. In some embodiments, the framing members are formed of timber, such as wood studs. In other embodiments, the framing members are formed of metal, such as such as steel or aluminum studs. Other materials may also be used for the framing members.

Figure 3A:
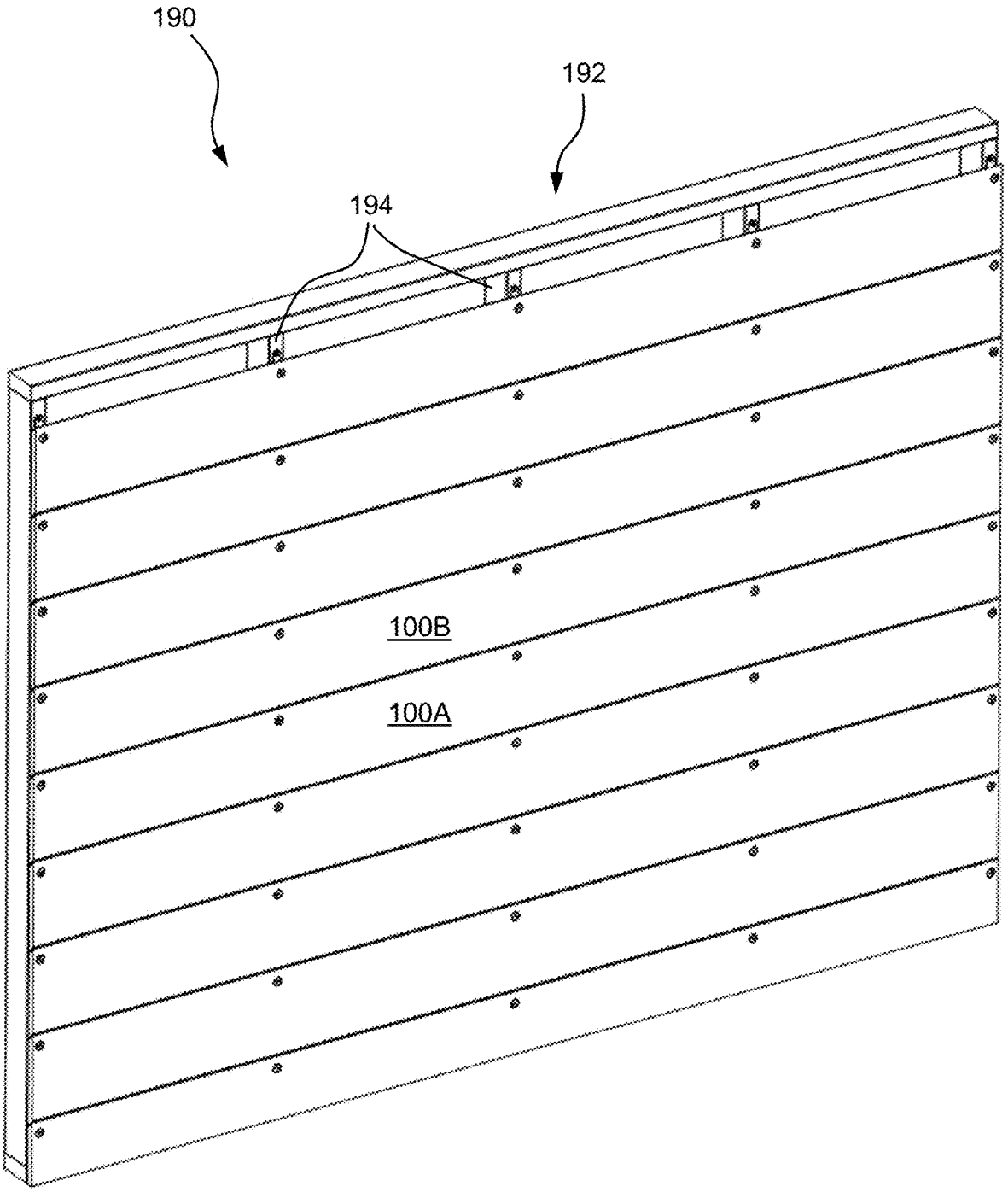
FIG. 3A is a schematic perspective view of a building surface system according to an embodiment of the disclosure.

Such a building surface system is shown in FIG. 3A. Building surface system 190 includes a support structure 192 and a plurality of building surface products, including a first building surface product 100A and second building surface product 100B, attached to support structure 192. The support structure 192 includes a group of vertical framing members 194 arranged across the support structure to form a support surface. Each of the building surface products is secured to support structure 192 via the fastener assemblies of the disclosure.

Figure 3B:
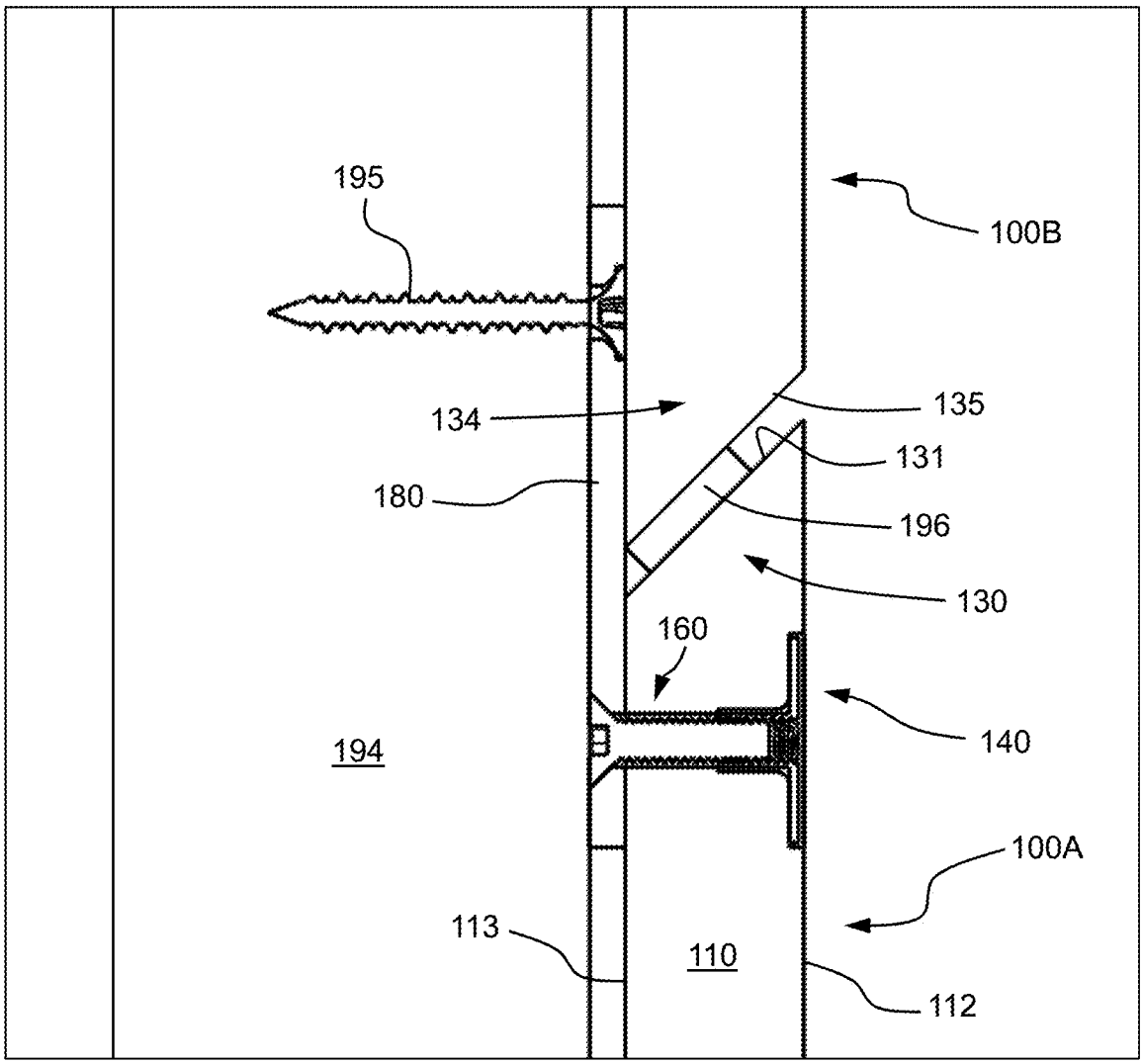
FIG. 3B is a schematic cross-sectional view of a portion of the building surface system of FIG. 3A.

In various embodiments of the building surface system of the disclosure, the linking fastener of the first fastener assembly of the first building surface product holds a first tab against the rear surface of the panel of the first building surface product, and the first building surface product is attached to the support structure via the first tab. For example, FIG. 3B shows a cross-sectional view of the connection of the first building surface product 100A to a framing member 194 of the support structure 192. As shown, the linking fastener 160 of the first fastener assembly 102 secures a first tab 180 against the rear surface 113 of the panel 110 of first building surface product 100A. The first tab 180 is further secured to framing member 194 with a mechanical fastener, such that the first building surface product 100A is attached to the support structure 192.

In various embodiments of the building surface system of the disclosure, the first building surface product includes a first projection that is positioned in front of a portion of the panel of the second building surface product so as to hold the panel of the second building surface product against the support structure. For example, as shown in FIG. 3B, first building surface product 100A includes a first projection 130 at its upper side that is formed by an upward extension of the front surface 112 of panel 110 and an angled rear face 131. At the lower side of second building product 100B, the panel includes a second projection 134 that is formed by a downward extension of the rear surface 113 and an angled front face 135. The two building surface products 100A, 100B are positioned so that the first projection 130 of the first building surface product 100A is in front of the second projection 134 of the second building surface product 100B. Accordingly, the angled front face 135 of second building surface product 100B is secured against the angled rear face of first building surface product 100A, so that the first building surface product 100A assists in holding the second building surface product 100B against the support structure.

The description of the angled front face of the first projection being secured against the angled rear face of the second projection includes a direct engagement of the respective angled front face and angled rear face as well as indirect engagement. For example, in some embodiments, the building surface system includes a spacer positioned between an edge along the first side of the first building surface product and an edge along the second side of the second building surface product. For example, as shown in the exploded view of FIG. 3B, a spacer 196 is configured to be placed between the angled rear face 131 of the first projection 130 of the first building surface product 100A and the angled front face 135 of the second projection 134 of second building surface product 100B. The use of similar spacers between neighboring building surface products over the height of the building surface system can provide accurate positioning of the building surface products without the need for careful measuring or relying on the geometry of the vertical rail to set the spacing.

In another aspect, the disclosure provides a method of forming the building surface system according to the disclosure. The method includes positioning the first building surface product against the support structure, securing the first building surface product to the support structure, position the second building surface product against the support structure and adjacent to the first building surface product, and securing the second building surface product to the support structure. For example, as shown in FIG. 3A, each of the shown building surface products, such as first building surface product 100A and second building surface product 100B, is positioned against the support structure 192 and then secured in place.

In various embodiments of the method as otherwise described herein, securing the first building surface product against the support structure includes attaching a tab of the first building surface product to a framing element of the support structure, wherein the tab is held to the panel of the first building surface product by the linking fastener of the first fastener assembly. For example, as shown in FIG. 3B the linking fastener 160 of the first fastener assembly 102 secures a first tab 180 against the rear surface 113 of the panel 110 of first building surface product 100A. The tab 180 is then secured to the vertical framing member 194, for example, using a mechanical fastener, such as a wood screw 195.

In various embodiments of the method as otherwise described herein, positioning the second building surface product includes placing a second projection of the second building surface product behind a first projection of the first building surface product. For example, the second building surface panel 100B is lowered onto the first building surface product 100A so that the second projection 134 of first building surface product 100A is placed behind the first projection 130 of second building surface product 100B. As a result, the angled front face 135 of second building surface product 100B is secured against the angled rear face of first building surface product 100A, so that the first building surface product 100A assists in holding the second building surface product 100B against the support structure.

In various embodiments of the method as otherwise described herein, the method includes positioning a spacer between an edge along the first side of the first building surface product and an edge along the second side of the second building surface product. For example, as shown in FIG. 3B, a spacer 196 is placed between the angled rear face 131 of the first projection 130 of the first building surface product 100A and the angled front face 135 of the second projection 134 of second building surface product 100B. The spacer can assist in providing a uniform spacing between the first building surface product 100A and the second building surface product 100B before the second building surface product 100B is fixed in place. Once the second building surface product 100B is in the desired position, the tabs 180 of the second building surface product 100B can be fastened into place.

In some embodiments of the method, the spacers are removed after the building surface products are secured to the support structure. In other embodiments, the spacers are retained and form part of the building surface structure. For example, in some embodiments, the spacers provide a decorative element between the building surface products, such as an accent line. Further, in some embodiments, the spacers may also perform a performance function, such as sealing the space for the prevention of thermal, odor or air leakage between the spaces. The spacers may also perform additional structural benefits, such as increased mechanical strength of the structure. Alternatively, the spacers may provide a cushioning function, such as to allow for seismic vibrations to pass through the system without damage to the panels. For example, the spacers may be soft to provide acoustic benefits. Alternatively, in some embodiments, the spacers may be hard.

Various additional embodiments and aspects of the disclosure are provided by the following enumerated embodiments, which can be combined in any number and in any combination not logically or technically inconsistent.

Embodiment 1. A building surface product comprising:

a substantially planar panel having a front surface, a rear surface, a first side, a second side, a first end, a second end, a gypsum body between the front surface and rear surface, and a first hole extending through the gypsum body and having a front end and a rear end; and a first fastener assembly positioned in the first hole, the first fastener assembly comprising:

an embedded fastener including a threaded body that extends through the first hole and has a front end a rear end, and a lateral projection disposed at the front end of the threaded body, and a linking fastener including a threaded body that engages the threaded body of the embedded fastener, the linking fastener extending outward from the rear end of the first hole, wherein the first fastener assembly is contained behind the front surface of the panel.

Embodiment 2. The building surface product according to embodiment 1, wherein the threaded body of the embedded fastener includes a hollow barrel with internal threads, and the threaded body of the linking fastener includes a shaft with external threads.

Embodiment 3. The building surface product according to embodiment 1 or embodiment 2, wherein the lateral projection of the embedded fastener includes a flat base extending radially outward from the threaded body of the embedded fastener.

Embodiment 4. The building surface product according to any of embodiments 1 to 3, wherein the embedded fastener is formed as a tee nut.

Embodiment 5. The building surface product according to any of embodiments 1 to 4, wherein the linking fastener includes a head that extends radially outward from the threaded body, and wherein the head of the linking fastener is positioned outside of the first hole.

Embodiment 6. The building surface product according to any of embodiments 1 to 5, wherein the linking fastener is formed as a bolt.

Embodiment 7. The building surface product according to embodiment 1, wherein the threaded body of the embedded fastener includes a shaft with external threads, and the threaded body of the linking fastener includes a barrel with internal threads.

Embodiment 8. The building surface product according to embodiment 1 or embodiment 7, wherein the lateral projection of the embedded fastener is formed by a head at the front end of the embedded fastener.

Embodiment 9. The building surface product according to any of embodiments 1, 7, and 8, wherein the embedded fastener is formed as a bolt.

Embodiment 10. The building surface product according to any of embodiments 1 and 7-9, wherein the linking fastener includes a base extending radially outward from the threaded body, and wherein the base is positioned outside the first hole.

Embodiment 11. The building surface product according to any of embodiments 1 and 7-10, wherein the linking fastener is formed as a tee nut.

Embodiment 12. The building surface product according to any of embodiments 1 to 11, wherein the embedded fastener is contained between the front surface and the rear surface of the panel.

Embodiment 13. The building surface product according to any of embodiments 1 to 12, wherein the panel includes a first projection extending along the first side of the panel and positioned at the front surface of the panel, and a second projection extending along the second side of the panel and configured to fit behind a first projection of a neighboring panel.

Embodiment 14. The building surface product according to embodiment 13, wherein the first projection has an angled rear face and the second projection has an angled front face.

Embodiment 15. The building surface panel according to any of embodiments 1 to 14, wherein a portion of the panel that extends from a centerline of the panel to the second side of the panel is free of fasteners.

Embodiment 16. The building surface panel according to any of embodiments 1 to 15, further comprising a first tab that is secured to the panel by the linking fastener.

Embodiment 17. The building surface panel according to embodiment 16, wherein the first tab extends outward from the first side of the panel.

Embodiment 18. The building surface panel according to any of embodiments 1 to 17, wherein the embedded fastener is covered at the first surface of the panel by a material layer.

Embodiment 19. The building surface panel according to embodiment 18, wherein the material layer is joint compound.

Embodiment 20. The building surface panel according to any of embodiments 1 to 19, wherein a layer of paint extends across the front surface of the panel and over the embedded fastener so as to obscure the embedded fastener.

Embodiment 21. The building surface pane according to any of embodiments 1 to 20, wherein a width of the panel from the first side to the second side is at least 3 inches, e.g., at least 4 inches, e.g., at least 6 inches.

Embodiment 22. The building surface pane according to any of embodiments 1 to 21, wherein a width of the panel from the first side to the second side is no more than 9 feet, e.g., no more than 4 feet, e.g., no more than 3 feet, e.g., no more than 1 foot.

Embodiment 23. The building surface pane according to any of embodiments 1 to 22, wherein a length of the panel from the first end to the second end is at least 1 foot, e.g., at least 2 feet, e.g., at least 4 feet.

Embodiment 24. The building surface pane according to any of embodiments 1 to 23, wherein a length of the panel from the first end to the second end is no more than 20 feet, e.g., no more than 18 feet, e.g., no more than 15 feet.

Embodiment 25. The building surface pane according to any of embodiments 1 to 24, wherein a thickness of the panel is at least ¼ inch, e.g., at least ⅜ inch, e.g., at least % inch.

Embodiment 26. The building surface pane according to any of embodiments 1 to 25, wherein a thickness of the panel is no more than 4 inches, e.g., no more than 3 inches, e.g., no more than 2 inches.

Embodiment 27. The building surface pane according to any of embodiments 1 to 26, wherein the gypsum body comprises a reinforced gypsum material.

Embodiment 28. The building surface pane according to embodiment 27, wherein the gypsum body includes at least 1% by weight polymer.

Embodiment 29. The building surface pane according to embodiment 28, wherein the polymer includes starch and/or polyvinyl acetate.

Embodiment 30. The building surface pane according to embodiment 27, wherein the gypsum body includes at least 1% by weight of reinforcing fibers.

Embodiment 31. The building surface pane according to any of embodiments 1 to 30, further comprising a facing sheet that lines the gypsum body along at least one of the front surface and the rear surface.

Embodiment 32. The building surface pane according to any of embodiments 1 to 31, wherein the facing sheet is a paper facing.

Embodiment 33. A building surface system comprising:

a support structure including a plurality of framing members that form a support surface;

a first building surface product according to any of embodiments 1 to 32 attached to the support structure; and a second building surface product according to any of embodiments 1 to 32 attached to the support structure and positioned adjacent to the first building surface product.

Embodiment 34. The building surface system according to embodiment 33, wherein the linking fastener of the first fastener assembly of the first building surface product holds a first tab against the rear surface of the panel of the first building surface product, and wherein the first building surface product is attached to the support structure via the first tab.

Embodiment 35. The building surface system according to embodiment 34, wherein the first tab is attached to the support structure using a mechanical fastener.

Embodiment 36. The building surface system according to any of embodiments 33 to 35, wherein the first building surface product includes a first projection that is positioned in front of a portion of the panel of the second building surface product so as to hold the panel of the second building surface product against the support structure.

Embodiment 37. The building surface system according to any of embodiments 33 to 36, further comprising a spacer positioned between an edge along the first side of the first building surface product and an edge along the second side of the second building surface product.

Embodiment 38. A method of forming the building surface system according to any of embodiments 33 to 37, the method comprising:

positioning the first building surface product against the support structure;

securing the first building surface product to the support structure;

position the second building surface product against the support structure and adjacent to the first building surface product; and securing the second building surface product to the support structure.

Embodiment 39. The method according to embodiment 38, wherein securing the first building surface product against the support structure includes attaching a tab of the first building surface product to a framing element of the support structure, wherein the tab is held to the panel of the first building surface product by the linking fastener of the first fastener assembly.

Embodiment 40. The method according to embodiment 38 or 39, wherein positioning the second building surface product includes placing a second projection of the second building surface product behind a first projection of the first building surface product.

Embodiment 41. The method according to any of embodiments 38 to 40, further comprising positioning a spacer between an edge along the first side of the first building surface product and an edge along the second side of the second building surface product.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface product comprising:

a substantially planar panel having a front surface, a rear surface, a first side, a second side, a first end, a second end, a gypsum body between the front surface and rear surface, and a first hole extending through the gypsum body and having a front end and a rear end;

a first fastener assembly positioned in the first hole, the first fastener assembly comprising:

an embedded fastener including a first threaded body that extends through the first hole and has a front end and a rear end, and a lateral projection disposed at the front end of the first threaded body, and a linking fastener including a second threaded body that engages the first threaded body of the embedded fastener, the linking fastener extending outward from the rear end of the first hole;

a first tab that is secured to the rear surface of the substantially planar panel by the linking fastener, wherein the first tab extends outward from the first side of the substantially planar panel, wherein the first fastener assembly is contained behind the front surface of the substantially planar panel.

2. The building surface product according to claim 1, wherein the first threaded body of the embedded fastener includes a hollow barrel with internal threads, and the second threaded body of the linking fastener includes a shaft with external threads.

3. The building surface product according to claim 1, wherein the lateral projection of the embedded fastener includes a flat base extending radially outward from the first threaded body of the embedded fastener.

4. The building surface product according to claim 1, wherein the linking fastener includes a head that extends radially outward from the second threaded body, and wherein the head of the linking fastener is positioned outside of the first hole.

5. The building surface product according to claim 1, wherein the first threaded body of the embedded fastener includes a shaft with external threads, and the second threaded body of the linking fastener includes a barrel with internal threads.

6. The building surface product according to claim 1, wherein the lateral projection of the embedded fastener is formed by a head at the front end of the embedded fastener.

7. The building surface product according to claim 1, wherein the linking fastener includes a base extending radially outward from the second threaded body, and wherein the base is positioned outside the first hole.

8. The building surface product according to claim 1, wherein the embedded fastener is contained between the front surface and the rear surface of the substantially planar panel.

9. The building surface product according to claim 1, wherein the substantially planar panel includes a first projection extending along the first side of the panel and positioned at the front surface of the substantially planar panel, and a second projection extending along the second side of the panel and configured to fit behind a first projection of a neighboring panel.

10. The building surface product according to claim 9, wherein the first projection has an angled rear face and the second projection has an angled front face.

11. The building surface product according to claim 1, wherein a portion of the substantially planar panel that extends from a centerline of the panel to the second side of the substantially planar panel is free of fasteners.

12. The building surface product according to claim 1, wherein the embedded fastener is covered at the first surface of the substantially planar panel by a layer of joint compound.

13. The building surface product according to claim 1, wherein a layer of paint extends across the front surface of the substantially planar panel and over the embedded fastener so as to obscure the embedded fastener.

14. A building surface system comprising:

a support structure including a plurality of framing members that form a support surface;

a first building surface product and a second building product according to claim 1 each attached to the support structure with the rear surface of the substantially planar panel thereof facing the support structure, the second building product being positioned adjacent to the first building surface product.

15. The building surface system according to claim 14, wherein the first building surface product is attached to the support structure via the first tab.

16. The building surface system according to claim 14, wherein the first building surface product includes a first projection that is positioned in front of a portion of the substantially planar panel of the second building surface product so as to hold the substantially planar panel of the second building surface product against the support structure.

17. The building surface system according to claim 14, further comprising a spacer positioned between an edge along the first side of the first building surface product and an edge along the second side of the second building surface product.

18. A method of forming the building surface system according to claim 14, the method comprising:

positioning the first building surface product against the support structure;

securing the first building surface product to the support structure;

positioning the second building surface product against the support structure and adjacent to the first building surface product; and securing the second building surface product to the support structure.

19. The building surface structure according to claim 14, wherein the second building surface product is disposed in front of the first tab of the first building product.

20. A building surface product comprising:

a substantially planar panel having a front surface, a rear surface, a first side, a second side, a first end, a second end, a gypsum body between the front surface and rear surface, and a first hole extending through the gypsum body and having a front end and a rear end;

a first fastener assembly positioned in the first hole, the first fastener assembly comprising:

an embedded fastener including a first threaded body that extends through the first hole and has a front end and a rear end, and a lateral projection disposed at the front end of the first threaded body, and a linking fastener including a second threaded body that engages the first threaded body of the embedded fastener, the linking fastener extending outward from the rear end of the first hole, the linking fastener having been threadedly engaged with the embedded fastener from the rear end of the first threaded body thereof; and a first tab that is secured to the rear surface of the substantially planar panel by the linking fastener, wherein the first tab extends outward from the first side of the substantially planar panel, wherein the first fastener assembly is contained behind the front surface of the substantially planar panel.

21. The building surface system according to claim 17, wherein the spacer seals a space between the first building surface product and the second building surface product.

22. The building surface system according to claim 17, wherein in each of the first building product and the second building product the substantially planar panel includes a first projection having an angled rear face extending along the first side of the panel and positioned at the front surface of the substantially planar panel, and a second projection having an angled front face extending along the second side of the panel, the angled front face of the second projection of the second building surface product being disposed behind the angled rear face of the first projection of the first building surface panel, and the spacer is disposed between the angled rear face of the first projection of the first building surface product and the angled front face of the second projection of the second building surface product.

23. The building surface product according to claim 1, further comprising a paper facing lining the gypsum body along at least one of the front surface and the rear surface of the substantially planar panel.

24. The building surface product according to claim 1, further comprising a fiberglass mat lining the gypsum body along at least one of the front surface and the rear surface of the substantially planar panel.

* * * * *